US005196172A

United States Patent [19]

Weinberg et al.

[11] Patent Number: 5,196,172

[45] Date of Patent: Mar. 23, 1993

[54] APPARATUS FOR THE FLUID CATALYTIC CRACKING OF HYDROCARBON FEED EMPLOYING A SEPARABLE MIXTURE OF CATALYST AND SORBENT PARTICLES

[75] Inventors: Harold N. Weinberg, Livingston, N.J.; W. Benedict Johnson, Pebble Beach, Calif.; Michael F. Raterman, Doylestown, Pa.; Barry K. Speronello, Belle Mead, N.J.; William J. Reagan, Naperville, Ill.; Larry G. Sherman, Flemington, N.J.

[73] Assignee: Engelhard Corporation, Iselin, N.J.

[21] Appl. No.: 724,235

[22] Filed: Jul. 1, 1991

Related U.S. Application Data

[60] Division of Ser. No. 515,540, Apr. 26, 1990, Pat. No. 5,059,302, which is a continuation of Ser. No. 352,433, May 16, 1989, abandoned.

[51] Int. Cl.[5] ..... B01J 8/26; F27B 15/08

[52] U.S. Cl. ..... 422/144; 208/113; 208/155; 208/164; 422/141; 422/145; 422/147

[58] Field of Search ..... 422/144, 145, 147, 141; 208/113, 155, 164

[56] References Cited

U.S. PATENT DOCUMENTS

| | | | |
|---|---|---|---|
| 3,777,678 | 12/1973 | Lutes et al. | 110/244 |
| 3,846,280 | 11/1974 | Owen et al. | 422/144 |
| 3,904,548 | 9/1975 | Fagan et al. | 208/164 |
| 4,026,821 | 5/1977 | Schoofs et al. | 208/113 |
| 4,036,779 | 7/1977 | Schatz et al. | 422/144 |
| 4,875,994 | 10/1989 | Haddad et al. | 208/113 |

*Primary Examiner*—Robert J. Warden
*Assistant Examiner*—Amalia Santiago

[57] ABSTRACT

The present invention features the use of a particulate sorbent and a particulate FCC catalyst, which are physically separable, sequentially in the same FCC riser, followed by separation of commingled spent catalyst and sorbent particles from vapors, and the subsequent primary partial regeneration and heat up of spent sorbent particles and catalysts particles in an oxygen deficient burning zone, followed by physical separation of partially regenerated catalyst and sorbent particles, preferably using a cyclonic classifier to effect the separation. This is followed by secondary regeneration of the resulting segregated partially regenerated sorbent and catalyst streams in oxygen rich combustion zones to fully regenerate sorbent and catalyst particles.

6 Claims, 3 Drawing Sheets

340
320
330
310
SECOND STAGE REGENERATOR
300
290
280
260
250
220
230
210
400
360
350
370
STEAM
390
STEAM
150
140
11
10
9
10a
12
13a
13
STEAM
170
160
180
190a
200
190 AIR
240
STRIPPER
8
MAKE-UP ZEOLITE CATALYST
242
5a
380a
7
6
5
380
SPENT SORBENT
380b
FRESH SORBENT
1
2
4
FEED HYDROCARBON AND STEAM
3
3a
AIR
270

APPARATUS FOR THE FLUID CATALYTIC CRACKING OF HYDROCARBON FEED EMPLOYING A SEPARABLE MIXTURE OF CATALYST AND SORBENT PARTICLES

This is a divisional of copending application Ser. No. 07/515,540, filed Apr. 26, 1990, now allowed as U.S. Pat. No. 5,059,302 issued Oct. 22, 1991, which is a continuation of Ser. No. 07/352,433 filed May 16, 1989, abandoned.

FIELD OF THE INVENTION

This invention relates to an improvement in the fluid catalytic cracking (FCC) of hydrocarbon feedstocks, especially those containing one or more impurities, such as metals, basic nitrogen compounds and asphaltenes (Conradson carbon), in which a particulate fluidizable material that is a sorbent is used to remove one or more of such impurities from the feedstock before the feedstock contacts particles of cracking catalyst for conversion of the feedstock into lighter products, such as gasoline.

BACKGROUND OF THE INVENTION

It is well known that hydrocarbon oils containing an appreciable concentration of materials boiling above about 1050° F. are difficult to process in conventional FCC operations because these feeds contain appreciable concentrations of materials which both temporarily and permanently impair the effectiveness of conventional zeolitic cracking catalysts. These impurities include: asphaltenes (Conradson carbon) which deposit on the catalyst particles to form coke, frequently in an amount in excess of that which can be tolerated by an existing FCC regeneration system; metals, especially nickel and vanadium, usually at least partially in the form of porphyrins, which are frequently referred to as catalyst poisons and which build up on catalyst particles during reaction/regeneration cycles to levels necessitating undesirably high fresh catalyst replacement levels; and nitrogenous bases which interfere which acidic cracking sites of the zeolite component of the catalyst during the cracking cycle. Exemplary of such impure oils are atmospheric and vacuum residual oils (resids), tar sand oils as well as clean gas oils blended with resids or other impure oils. Even clean gas oils contain deleterious nitrogenous bases. Sodium in feedstocks or introduced in steam used in FCC processing is also harmful to catalytic cracking.

Staged processing in separate process steps is old in the catalytic cracking art. It has been proposed, for example, to add to a conventional cyclic FCC operation a vapor/solid pretreatment stage to reduce the content of impurities in oil feedstocks before the oils are cracked catalytically. In particular, it has been proposed to remove the impurities by selectively vaporizing the valuable high hydrogen components of the oil by contacting the oil with hot particles of sorbent particles, such as microspheres of calcined clay, leaving carbonaceous, metals, nitrogenous and sulfurous impurities present as a deposit on the particles of sorbent contact material. Proposed equipment takes advantage of the fast fluid riser type of equipment used in FCC units, namely, a riser in which selective vaporization and impurity removal takes place by dilute phase ultrashort contact between feed and hot contact material and a regenerator (burner) in which coke is burned from the impurityladen particles of contact material, thereby renewing the activity of the contact material and supplying the heat needed by the particles to vaporize incoming charge of hydrocarbon feed to the riser. The sorbent particles used in the process have a low surface area, typically below 10 $m^2/g$ by the BET method, and are essentially devoid of catalytic cracking activity. Such cracking that does take place is largely of thermal character. Since the vaporization takes place in a fast fluid riser, contact between hydrocarbon and sorbent is short, about 2 seconds or less, and little undesirable recracking of vapors takes place in the riser. In a further attempt to avoid recracking, the vapors and particles of sorbent are rapidly separated from each other and the separated vapors are quenched prior to being charged to the FCC unit. This type of process, referred to commercially as the ART process, is described in numerous publication and patents, exemplary of which are: U.S. Pat. No. 4,263,128 (Bartholic), U.S. Pat. No. 4,781,818 (Reagan et al.), and "The ART Process Offers Increased Refinery Flexibility," R. P. Haseltine et al., presented at the 1983 NPRA Conference in San Francisco.

In an embodiment of the pretreatment processing scheme described above, the vapors from the selective vaporization step, after removal of spent sorbent particles therefrom, are charged directly to an FCC unit without prior quenching. See U.S. Pat. No. 4,525,268 (Barger, et. al.)

A characteristic of these pretreatment processing schemes is that selective vaporization with associated impurities removal and cracking take place in different units and regeneration of contact sorbent and cracking catalyst also takes place in different units. Thus, particles of zeolite cracking catalyst and sorbent particles are never intentionally commingled during the cyclic process. In fact, the zeolitic catalyst particles and sorbent particles are intentionally isolated from each other and only an upset in a unit operation results in commingling of catalyst and sorbent. The practice of maintaining isolation of sorbent and catalyst particles is dictated in part by the intent to avoid contamination of zeolitic catalyst particles during the cracking cycle with impurities picked up from the oil and deposited on the sorbent particles and in part by the need to use separate regenerators to avoid undesired contamination of the catalyst with metals and nitrogenous bases as a result of migration from the sorbent during high temperature regeneration. Furthermore, the regeneration requirements are generally different for the two different classes of coked materials because of the difference between the nature of the coke on the sorbent and catalyst particles. Regenerators for the sorbent usually require higher temperature regeneration than is needed to regenerate catalyst particles. The temperatures needed to burn the relatively high hydrogen content coke deposit on sorbent particles may result in the destruction of the zeolitic component catalyst particles and/or result in overcracking of feedstock.

The following relate to staged contacting in FCC or other catalytic cracking operations:

U.S. Pat. No. 2,472,723, (Peet), U.S. Pat. No. 2,956,004, (Conn, et. al.) and U.S. Pat. No. 3,146,188, (Gossett) described discrete staged treating process for upgrading heavy feeds.

U.S. Pat. No. 3,639,228, (Carr, et. al.) and U.S. Pat. No. 4,257,875 (Lengemann, et. al.) described staged contacting using a single riser and a single regenerator, but utilizing only one type of catalyst.

U.S. Pat. No. 2,943,040, (Weisz) discloses catalytic cracking processes using a mixture of catalysts of different particles sizes, one of which is an absorbent for metal and is introduced into a cracking process which may be fluidized. The absorbent is concentrated at one end, i.e., see col. 1, line 60 and following. The absorbent need not have catalytic cracking activity, i.e., col. 1, line 66. The patent does not teach the use of a riser or the staged regeneration contemplated by the present invention.

U.S. Pat. No. 4,416,814, (Zahner) relates to the use of two separate reactors with segregated feeds employing a single regenerator and two solids which may or may not be the same type but which are of different sizes.

In U.S. Pat. No. 4,525,268, (Barger), (discussed supra), staged contacting is practiced, but both segregated reactors and regenerators are utilized.

Pilot plant demonstrations of discrete two-stage treatment from three different crude oils are described in "Two Stage Non-Hydrogenative Processing of Residue," Krishna, AS. and Both, D. J.; 1. *E.C. Proc. Des. Dev.* 1985, 24, 1266–1275.

In U.S. Pat. No. 4,090,948 (Schwarzenbek) recycled spent (coked) cracking catalyst vaporizes feed in a lower zone of a riser in which vaporized feed is subsequently contacted with a recycled regenerated catalyst. Stripped spent catalyst is separated into two portions, one of which is recycled without regeneration to the lower zone of the riser and the other is recycled to an intermediate point in the riser.

Staged regeneration of spent fluid cracking catalysts with initial low temperature regeneration followed by high temperature full regeneration to control undesirable metals effects of high temperature is known in the art. See, for example, U.S. Pat. No. 2,943,040, (Weisz).

Other prior art includes:

U.S. Pat. No. 2,541,077, (Leffer)
U.S. Pat. No. 4,071,436, (Blanton, Jr., et. al.)
U.S. Pat. No. 4,116,814, (Zahner)
U.S. Pat. No. 4,243,556, (Blanton, Jr.)
U.S. Pat. No. 4,469,588, (Hettinger, Jr., et. al.)
U.S. Pat. No. 4,495,304, (Yoo, et. al.)
U.S. Pat. No. 4,569,754, (Moore)
U.S. Pat. No. 4,606,813, (Byrne, et. al.)
U.S. Pat. No. 4,655,905, (Plumail, et. al.)
U.S. Pat. No. 4,657,664, (Evans, et. al.)
U.S. Pat. No. 4,728,417, (Aldag, Jr. et. al.)
U.S. Pat. No. 4,729,826, (Lindsay, et. al.)

While it is well know that by incorporating a discrete sorption step upstream of the catalytic cracking step, improved activity and higher selectivity to desired products can be effected in the cracking operation, the known processing has involved the integration of separate processing steps. In many cases, the potential capital and operating steps upstream of the catalytic cracker would have more than offset the credits in the cracker.

One object of the present invention is to minimize the capital and operating expenses of staged processing, preferably within existing catalytic cracking unit designs with a minimal revamp, to provide for separate addition of sorbent solid and cracking catalyst to the same riser reactor, separation of sorbent from catalyst and segregated regeneration to fully burn coke from sorbent and catalyst particles under conditions appropriate for both so as to avoid transfer of potential catalyst poisons, especially metals, from the particles of sorbent to the particles of catalyst during regeneration.

The invention also provides a means for effectively increasing the throughput of existing catalytic crackers using conventional feeds such as clean gas oils and/or permits the economical processing of heavier feed.

SUMMARY OF THE INVENTION

The present invention provides novel methods and apparatus for the continuous fluid cyclic catalyst cracking of hydrocarbons with a zeolitic cracking catalyst in a fast fluid riser using particles of an essentially noncatalytic sorbent contact material to remove impurities from the feedstock and to vaporize the feedstock prior to cracking. The process of the invention features a novel combination of steps which, in combination, may result in substantial benefits to operations in which feedstock is pretreated with a hot sorbent to remove impurities before cracking takes place.

The present invention features the use of a particulate sorbent and a particulate FCC catalyst, which are physically separable, sequentially in the same FCC riser, followed by separation of commingled spent catalyst and sorbent particles from vapors, and the subsequent primary partial regeneration and heat up of spent sorbent particles and catalysts particles in an oxygen deficient burning zone, followed by physical separation of partially regenerated catalyst and sorbent particles, preferably using a cyclonic classifier to effect the separation. This is followed by secondary regeneration of the resulting segregated partially regenerated sorbent and catalyst streams in oxygen rich combustion zones to fully regenerate sorbent and catalyst particles. Thus, in one aspect the invention features multiple stages of combustion for both the sorbent and catalyst particles, the primary stages being carried out while spent sorbent and catalyst are at least partially commingled and the secondary stages being carried out on segregated partially regenerated sorbent and catalyst particles.

Hot fully regenerated sorbent and catalyst particles are recycled to the riser as separate streams to the riser, the sorbent particles being recycled to a lower vaporization zone and the catalyst particles being recycled to an upper cracking zone, thereby providing for sequential contact of feedstock in the same riser with staged regeneration, initially of commingled sorbent and catalyst and subsequently of segregated sorbent and catalyst.

One or more risers with staged contact of sorbent and catalyst are within the scope of the invention.

Simultaneous primary partial regeneration and heat up of spent sorbent and catalyst particles is used to maintain the required heat balance in the system by simultaneously heating up catalyst and sorbent particles while preventing migration of contaminants such as metals, especially vanadium and nitrogen compounds, from the particles of sorbent to the catalyst particles which would occur if catalyst and sorbent particles were fully regenerated (coke essentially completely burned) when the spent catalyst and sorbent particles were commingled. In the case of heavy feedstock, noncatalytic coke (coke arising from deposition of Conradson Carbon and thermal coke) will be laid down disproportionally on the sorbent particles whereas the coke on the catalyst particles will be largely catalytic. Catalytic coke is extremely hydrogen deficient, typically containing 1 to 2% H. Conradson coke typically contains 6 to 7% H. Consequently, heat of combustion of a unit of catalytic coke is lower than that of a corresponding amount of coke derived from the laydown of Conradson carbon coke. By carrying out initial combustion of coke from commingled spent sorbent and spent catalyst, the heat generated by combustion of carbonaceous deposit on the sorbent particles is transferred during the first stage of combustion to the catalyst particles. This is critical to maintaining the simultaneous heat up of catalyst and sorbent particles while preventing undesirable migration of impurities from the sorbent to catalyst particles.

The secondary regeneration of segregated sorbent and catalyst particles offers the advantage of providing complete combustion, e.g., to coke levels below about 0.5%, preferably below 0.3%, most preferably below 0.1%, as required for effective utilization of both sorbent and catalyst particles. Segregated secondary regeneration also offers the means for providing additional independent temperature and other operating control capabilities, for example, the use of separate catalyst and/or sorbent coolers, to achieve optimum regeneration condition for both sorbent and catalyst. This also decouples the so-called "c/o" ratio (circulation rate of sorbent or catalyst relative to the circulation rate of feedstock) to achieve heat balance while providing for the circulation of sufficient hot sorbent to vaporize feed and sufficient hot catalyst to crack a desired amount of prevaporized feed.

The process of the invention also provides a unique means for reducing gross coke make by prevaporizing the feed with the sorbent before introducing an appropriate amount of cracking catalyst to the riser to achieve a desired conversion without overcracking. This permits cracking to take place at reduced c/o ratios for the active catalytic component and thereby minimizes the amount of catalytic carbon.

In an especially preferred embodiment of the invention the sorbent particles are finer than the catalyst particles. This offers a convenient means for effecting separation in an inertial separator. It also provides the added advantages of optimizing conditions for achieving desired plug flow and minimizing undesirable back mixing in the riser. Further, the use of finer sorbent particles facilitates heat transfer to the coarser catalyst particles during the initial stage of regeneration. However, it is within the scope of the invention to employ sorbent particles coarser than catalyst particles.

Another aspect of the invention comprises novel apparatus for catalytically cracking previously purified hydrocarbon feedstock. The apparatus features a single riser with separate means to charge sorbent to a lower zone and to charge catalyst particles to an upper zone therein, means to charge hydrocarbon feedstock to the lower zone of the riser, gas/solids separations means in communication with the outlet of the riser, means to circulate solids from the gas/solids separation means, means to steam strip solids, means to transfer solids to a primary regenerator, separation means to segregate the solids discharged from the primary regenerator, means to separately charge the solid effluents from the primary regenerator to secondary regenerator(s), and means to cycle separately solids from the secondary regenerator(s) to the riser for contact with incoming feed.

In one embodiment of this aspect of the invention, primary regeneration takes place in a transfer line and secondary regeneration of segregated sorbent and catalyst particles occurs in a regenerator provided with a cyclonic separator.

In another embodiment of the invention, primary regeneration and simultaneous segregation takes place in a cyclonic burner and secondary regeneration of segregated material takes place in the same regenerator.

DESCRIPTION OF PREFERRED EMBODIMENTS

Figure 1:
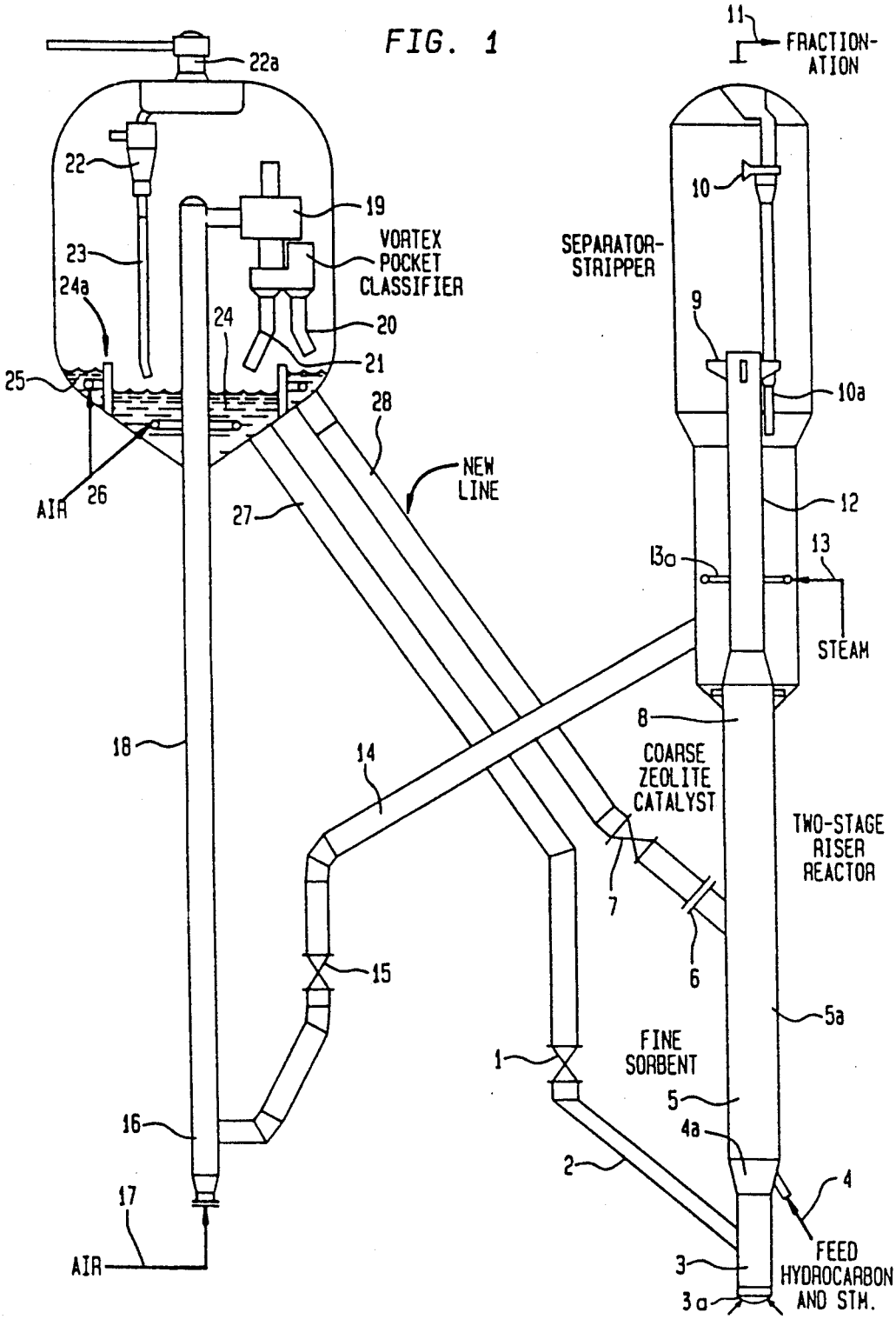
FIG. 1 is a diagrammatic illustration, with the major vessels shown in cross section, of an embodiment of the invention in which the first stage of regeneration is carried out in a transfer line, and segregation of sorbent and catalyst takes place in a cyclonic separator housed in the upper portion of a fluidized bed regenerator.

The present invention makes use of two different types of solids, one of which is referred to herein as a zeolitic cracking catalyst and the other is referred to as a sorbent. Both types are in the form of microspheres having a particle size distribution and density such that the particles can be fluidized in a fast fluid riser to form a dilute phase. Both types of particles are sufficiently attrition-resistant and of sufficient size to be capable of retention for a desired residence in the riser and regenerator (i.e., the bulk of particles are not so fine that they are flushed through the riser or regenerator). The types of particles must be sufficiently different in size and/or density such that they can be segregated from each other by physical means, preferably an inertial separator, or by flotation in a fluid bed.

The active cracking catalyst contains a zeolitic molecular sieve component having acidic cracking sites and a nonzeolitic matrix (which may, optionally have acidic cracking sites). Such catalysts are known in the art. Zeolitic components are preferably of the synthetic high silica forms of faujasite type crystal structure, e.g., Re—Y, HY, Re—H—Y, stabilized Y and ultrastabilized Y. Because the particles of cracking catalyst are diluted in the ractor with sorbent particles, it will usually be necessary to use a highly active cracking catalyst when conventional levels of feedstock conversions are sought and relatively large proportions of sorbent to catalysts are to be used. In such cases, recommended is the attrition-resistant high zeolite content (at least 40% zeolite) catalysts of the type described in U.S. Pat. No. 4,493,903 (Brown, et. al.), the teachings of which are incorporated herein by cross-reference. The manufacture of so-called "octane" versions of such high zeolite content catalysts is described in EPA 86301413.0, published Sep. 10, 1986. These catalysts are highly attrition resistant and are obtained by a process in which zeolite Y is crystallized in situ within pores of preformed spray dried microspheres composed of reactive forms of calcined kaolin clay. It will be understood that zeolitic catalysts other than those based on zeolite Y may be used.

Other zeolitic catalysts may contain zeolites such as Zeolite X, U.S. Pat. No. 2,882,244, as well as Zeolite B, U.S. Pat. No. 3,008,803; Zeolite D, Canada Pat. No.

661,981, Zeolite E, Canada Pat. No. 614,495; Zeolite F, U.S. Pat. No. 2,996,358; Zeolite H, U.S. Pat. No. 3,010,789; Zeolite J, U.S. Pat. No. 3,011,869; Zeolite L, Belgian Pat. No. 575,177; Zeolite M, U.S. Pat. No. 2,995,423; Zeolite O, U.S. Pat. No. 3,140,252; Zeolite Q, U.S. Pat. No. 2,991,151; Zeolite S, U.S. Pat. No. 3,054,657; Zeolite T, U.S. Pat. No. 2,950,952; Zeolite W, U.S. Pat. No. 3,012,853; Zeolite Z, Canada Pat. No. 614,495; and Zeolite Omega, Canada Pat. No. 817,915. Also ZK-4HJ, alpha beta and ZSM-type zeolites are useful. Moreover, the zeolites described in U.S. Pat. Nos. 3,140,249; 3,140,253; 3,944,482; and 4,137,151 are also useful, the disclosure of said patents being incorporated herein by reference. Catalysts containing various combinations of zeolites may be used.

The surface area of the catalyst particles (prior to steaming) is affected by zeolite content and is generally in the range of 200 to 800 $m^2/g$, usually 400 to 600 $m^2/g$, as determined by the BET procedure described in the cross-referenced '902 patent. Steaming will reduce surface area to an extent affected by steam pressure, steam temperature and zeolite species.

Presently preferred sorbent particles are obtained by spray drying kaolin clay to form microspheres and calcining the microspheres as described, for example, in U.S. Pat. No. 4,263,128, Bartholic. Especially preferred spray dried clay microspheres are calcined at elevated temperatures such as to crystallize mullite. This is described in U.S. Pat. No. 4,781,818, Reagan et. al., the teachings of which are incorporated herein by cross-reference. Microspheres of calcined clay are composed of silica and alumina. Other potentially useful sorbents are microspheres composed of alumina, silica, kyanite and other materials as enumerated in col. 6 of U.S. Pat. No. 4,256,567. Bartholic.

The sorbent particles function as sites for deposition of feedstock impurities including hydrogen deficient hydrocarbon (so-called Conradson or Ramsbottom carbon), metals such as nickel or vanadium usually present as porphyrins in the oil, basic nitrogen compounds and sulfur compounds. The particles are characterized by being essentially inert as cracking catalysts, e.g., MAT activity $<10$, and have low surface areas, typically 10 $m^2/g$ or less, preferably less than 5 $m^2/g$ or less and most preferably 1 $m^2/g$ or less.

The sorbent particles are preferably finer in size than the catalyst particles. Recommended size range for the sorbent particles is 20 to 200 microns, preferably 35–150 microns, and most preferably 30–90 microns, with an average size in the range of about 45 to 62 microns, and most preferably in the range of 50 to 55 microns. Recommended size range for the catalyst particles is 20 to 200 microns, preferably 100 to 175 microns, most preferably 80 to 150 microns, with an average size in the range of 64 to 68 microns, preferably 130 to 135 microns, and most preferably 105 to 110 microns.

The density of cracking catalyst particles is usually in the range of 1.28 to 2.08 g/cc. The density of sorbent particles, which will vary with the composition of the particles, is usually in the range of 1.75 to 3.00 g/cc.

The separation means and conditions employed to segregate catalyst and sorbent particles will dictate useful particle size distributions. Employing a pocket combustor separator, hereinafter described, with a catalyst having a density of 1.36 cc/g and calcined clay sorbent having a density of 1.92 cc/g, typical distributions for fresh materials are:

| Wt. % Smaller Than | Zeolitic Catalyst Particle Size Microns | Sorbent Particle Size Microns |
|---|---|---|
| 0 | 72 | 20 |
| 10 | 90 | 47 |
| 30 | 99 | 58 |
| 50 | 117 | 62 |
| 70 | 118 | 70 |
| 90 | 139 | 77 |
| 93 | 150 | 80 |
| 100 | 200 | 85 |

In other words, the particles of catalyst are all finer than 200 microns and larger than 72 microns with an average size of 117 microns. The particles of sorbent are finer, namely 100% finer than 85 microns with an average of 62 microns.

An advantage of the process of the invention is that the operation of resid/regeneration system can be varied to accommodate the cracking of feedstocks of varying composition. Generally, the desired level of conversions on the catalyst dictates the amount of catalyst charged to the riser. As desired conversion level increases, increasing levels of catalyst particles are charged to the riser to achieve that conversion at a desired selectivity. The ratio of sorbent particles to catalyst particles may vary during operation, depending on variations in the level of impurities in the feedstock as well as variations in conversion that is sought. The weight ratio of sorbent particles to catalyst particles is generally in the range of 10:1 to 10:10, usually in the range of 10:2 to 10:8, and most typically in the range of 10:4 to 10:6.

The level of separation of sorbent from catalysts particles need not be complete. It will suffice to separate to an extent such as to maintain the average metals on the catalyst particles at a low value, for example, below 3000 ppm Ni+V.

In the process of the invention the riser reactor consists of two zones where separate reactions take place in the catalytic cracking of heavy oils to produce high octane gasoline. In the primary zone the primary reaction is the vaporization of the oil with minimum cracking and at the same time the removal of heavy components such as asphaltenes and coke as well as heavy metal components, nitrogen and sulfur containing compounds from the vapor phase prior to contacting the zeolite catalyst in the second zone. This is accomplished by bringing a highly absorbent solid material of relatively fine particle size with a preferred average particle size of about 50 to 55 microns in contact with the heavy oil at the base of the riser reactor, the sorbent material having been regenerated in a second stage regenerator by combustion of the sorbed organic material and brought to a relatively high temperature during the combustion process in the order of 1250° F. to 1600° F., preferably 1300° F. to 1400° F. Due to the fine nature of the sorbent particles, a high degree of surface area is available for sorbing contaminants with rapid heat transfer to the oil for vaporization, resulting in fast acceleration of the particles to plug flow with minimum back flow.

In the secondary reaction zone zeolite cracking catalyst which is coarser than the sorbent with a preferred average particle size of 100–120 microns and which has been regenerated in a primary regenerator combustion until where it is brought to a temperature in the order of 1050° F. to 1250° F., preferably between 1100° F. to 1150° F. is introduced to the riser reactor. The sensible heat of the zeolite catalyst provides the necessary heat for cracking of the oil vapors and for bringing the temperature of the mixture to the desired reaction temperature. The zeolite meets the upflowing stream of vapor and sorbent particles containing the major part of the contaminants which could deactivate the zeolite and cause undesirable side reactions in the cracking zone. The fine upflowing particles also assist in the rapid acceleration of the zeolite by what is commonly called "piggy back effect" thereby reaching plug flow conditions and once again minimizing back flow. Thus the ideal situation for cracking of the feed is attained; short contact time with relatively cleaned completely vaporized oil where only the cracking of the oil takes place.

The cracked gases and combined solids are separated in a settling hopper followed by cyclone recovery. The gases carry on to equipment where they are condensed and fractionated into the desired components to produce predominantly high octane gasoline. The combined solids are stripped with steam before entering the regenerator system.

The regenerator system also consists of two zones, a primary zone where the coarser zeolite catalyst is preferentially burned of any organic components which have been deposited during the cracking reaction and brought to the desired temperature by the combustion and its proximity to combustion gases which are generated by the partial combustion of organic material deposited on the sorbent particles, and a secondary zone where further combustion of most of the remaining organic material on the sorbent and CO containing gases from the primary zone takes place.

During regeneration it is important to separate the coarser and finer solids as rapidly as possible to prevent contaminants which may be released during regeneration of the sorbent from being absorbed on the catalyst. To minimize release of these contaminants at this stage it is desirable to maintain relatively low oxygen levels in the combustion gases surrounding the sorbent and relatively low combustion temperatures. This is done by keeping the combustion air in the primary stage well below stoichiometric levels. On the other hand oxygen partial pressures should remain relatively high in the area where organic materials deposited upon the zeolite catalyst are being burned.

One embodiment of the present invention is presented in FIG. 1. Fresh regenerated sorbent, consisting of the finer portion of the total circulating inventory passes through a flow control valve (1) and is transferred (2) to the lift section (3). Lift gas (3*a*) which can be either steam, nitrogen, fuel gas or other similar media mixes with the adsorbent and conveys it upward in a dilute phase mixture to the feed injection point (4*a*). Hydrocarbon feed, steam, water and other possible diluents are injected into the riser through feed nozzles (4) at the feed injection point (4*a*). The feed mixture combines with the lift gas and sorbent and selectively vaporizes the lighter components of the hydrocarbon feed in the vaporization zone (5). In the selective vaporization zone heavy organometallics and precursors to coke are selectively deposited on the sorbent. The combined mixture then passes upward to the second solids injection point (5*a*) where it mixes with the catalytic component which enters the riser through the transfer line (6) and flow control valve (7).

The active catalytic component which is the coarser component in the circulating solids inventory, supplies the heat of cracking to the riser (8) reaction zone. The total mixture now consisting of catalytic solids, sorbent solids, hydrocarbons, steam and lift gas passes upwardly to the riser terminus and initial solids separator (9). After the initial separation, the bulk of the solids travels downwardly to the stripper (12) while the vapor containing unseparated adsorbent and catalyst travels upwardly to the reactor cyclone (10). The entrained solids and vapor enter the cyclone where the solids are substantially separated from the vapors. The vapors exit the cyclone and reaction section through the overhead transfer line (11) for the hydrocarbon recovery section.

Separated solids from the cyclone are transferred to the stripper (12) through the cyclone dipleg (10*a*) where they combine with the solids from the riser separator (9). Steam (13) is injected into the stripper through a distributor (13*a*) and passes upwardly through the stripper, displacing hydrocarbons before exiting the stripper. The combined mixture of steam and stripped hydrocarbons then combines with vapor from the riser before entering the cyclone (10). The stripped catalyst and sorbent exit the stripper through the spent solids standpipe (14) and level control valve (15) and enter the first combustion stage at the mix point (16).

Spent solids are mixed with a portion of the total combustion air (17) at the spent solids/air mix point (16). This mixture then travels upwardly in a dilute phase mixture through the first combustion zone (18) where a portion of the coke is burned off the catalyst and sorbent in an oxygen deficient environment. The mixture then enters the solids classifier (19) or "Pocket Vortex Separator" where the catalyst and sorbent are separated from the first stage combustion gas. A separator of this type is described in copending U.S. Patent Application Ser. No. 07,219,955, filed Jul. 15, 1988, "Method and Apparatus for Separation of Solids from a Gaseous Stream" the disclosure of which is incorporated herein by cross-reference. The coarser catalyst exits the classifier through the coarse solids dipleg (20) which discharges to an outer annulus fluid bed (25) in the regenerator. The finer sorbent is discharged into the inner fluid bed of the regenerator (24) through the fine solids dipleg (21).

Second stage combustion air (26) is then added to both the inner (24) and outer (25) fluid beds of the regenerator to complete the coke combustion. The two separate solids are maintained separate by the regenerator retaining wall (24*a*). The combustion gases from both fluid beds passes upwardly through the regenerator, combining with the combustion gases exiting from the classifier (19) and entering the regenerator cyclones (22). The regenerator cyclones complete the separation of the combustion gases and the entrained finer solids which are primarily sorbent. The collected solids are returned to the inner bed through the regenerator cyclone diplegs (23). Combustion gases then leave the unit via the flue gas line (22*a*). Regenerated sorbent exits the regenerator through the sorbent standpipe (27), traveling to the lift section (3) completing the sorbent loop. Regenerated catalyst exits the regenerator through the catalyst standpipe (28) to the riser (8), completing the catalyst loop.

Figure 2:
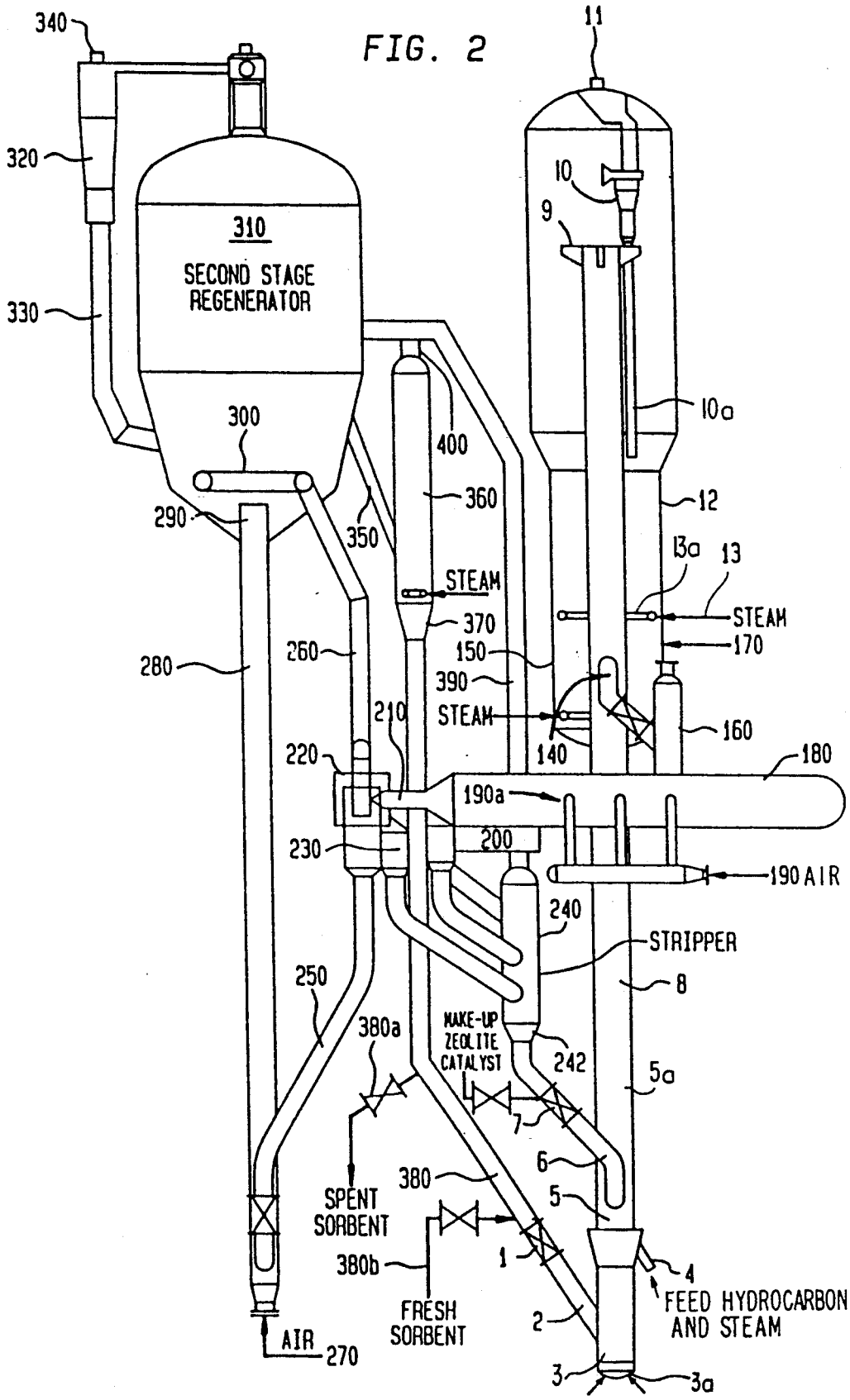
FIG. 2 is a diagrammatic illustration, with the major vessels shown in cross section as indicated by lines 2—2 in FIG. 3, (elevational view) of another embodiment of the invention in which the the first stage of regeneration is carried out in a cyclonic burner which provides for segregation of partially burned sorbent and catalyst particles and is external to the secondary regenerator.

A specific objective of the primary regeneration zone in the embodiment of the invention shown in FIG. 2 is to provide this piece of equipment as an add-on regenerator to existing catalytic cracking units in order to improve their cracking efficiency and particularly to permit heavier oil feeds to be processed.

In order to accomplish the above criteria in the embodiment of the invention shown in FIG. 2, centrifugal forces are applied in the primary regenerator combustor. These forces act to separate the solids in the same vessel, provide extended residence time for the zeolite coarse solids to complete the combustion of organic material deposited on these particles, locate them in an area of the vessel where oxygen concentration is the highest, and finally to efficiently remove them from the combustion gases and fine sorbent solids before these materials enter the second stage of regeneration.

The primary add-on regenerator combustor consists of an horizontal vessel commonly known as cyclone burner in the boiler business where the solids slag, but in this case the temperature levels are much lower and thus there is no slagging of the noncombustible particles. Combined spent solids from the reactor stripper are introduced at one end of the regenerator through a tangential nozzle or nozzles with a controlled amount of air which is fed to the withdrawal point from the stripper. The nozzle or nozzles is sized to attain a mixed velocity entering the regenerator of 30 to 60 ft/sec, preferably 40 to 50 ft/sec. The resulting centrifugal action forces the coarse zeolite particles to the inner periphery of the regenerator creating a separation from the finer sorbent particles, but still exposing them to a temperature rise created by the burning of organic material deposited on the solids. The centrifugal path of the coarse material initially passes the entering nozzle thereby creating even higher entering velocities which improves the separation of particles. Due to the fact that the catalyst is forced along the circumference of the regenerator its path is extended over the fine particles and gas resulting in increased residence time.

Additional air is added at points along the length of the regenerator through tangential ports to maintain the centrifugal forces, but also and most important to maintain a relatively high partial pressure of oxygen where the coarse cracking catalyst particles are located. The combination of relatively long residence time and high oxygen concentration results in efficient burn out of residual organics, even at the relatively low regenerator temperature.

At the exit end of the cyclone regenerator a small cylindrical vessel is attached to the regenerator shell with a slot opening between the two vessels. The small attachment is called a "Vortex Collection Pocket." As the coarse particles of cracking catalyst approach the slot they are peeled off and thus separated from the finer particles and gases. The remaining solids and gases exit from the regenerator and enter into a classifier where further separation of solids occur. This equipment consists of a cyclone separator where solids and gas are separated, but additional collection pockets are attached to the cyclone to complete the separation of coarse and fine particles.

The coarse particles of cracking catalyst which may contain small fraction of the finer material are withdrawn from the collection pockets and enter a stripper where they are steam stripped prior to entering the riser reactor. The fine sorbent solids are transported by additional air from the cyclone standpipe to the secondary regenerator which could be an existing vessel of a standard FCC unit. Here they are joined by the off gases of the cyclone classifier for final combustion and raising of the temperature of the mixture. The gases leaving the primary regenerator are fairly rich in CO concentration, but in the secondary regenerator the CO is oxidized to $CO_2$ with the additional air which was added to the fine solids for transport and exit the regenerator at acceptable levels. $NO_x$ levels are extremely low due to the two-stage combustion and temperature levels. $SO_x$ which is released in the combustion process is recovered downstream of the secondary regenerator. The flue gas leaving the secondary regenerator passes through a stage of cyclone where fines are separated and returned to the regenerator. Regenerated sorbent is withdrawn from the secondary regenerator to a steam stripper prior to entering the base of the riser reactor. When operation with heavy oil feeds is required, it may be necessary to add a catalyst cooler to the secondary regenerator to keep the unit in heat balance and still maintain the desired regeneration tempeatures due to additional coke make.

Figure 3:
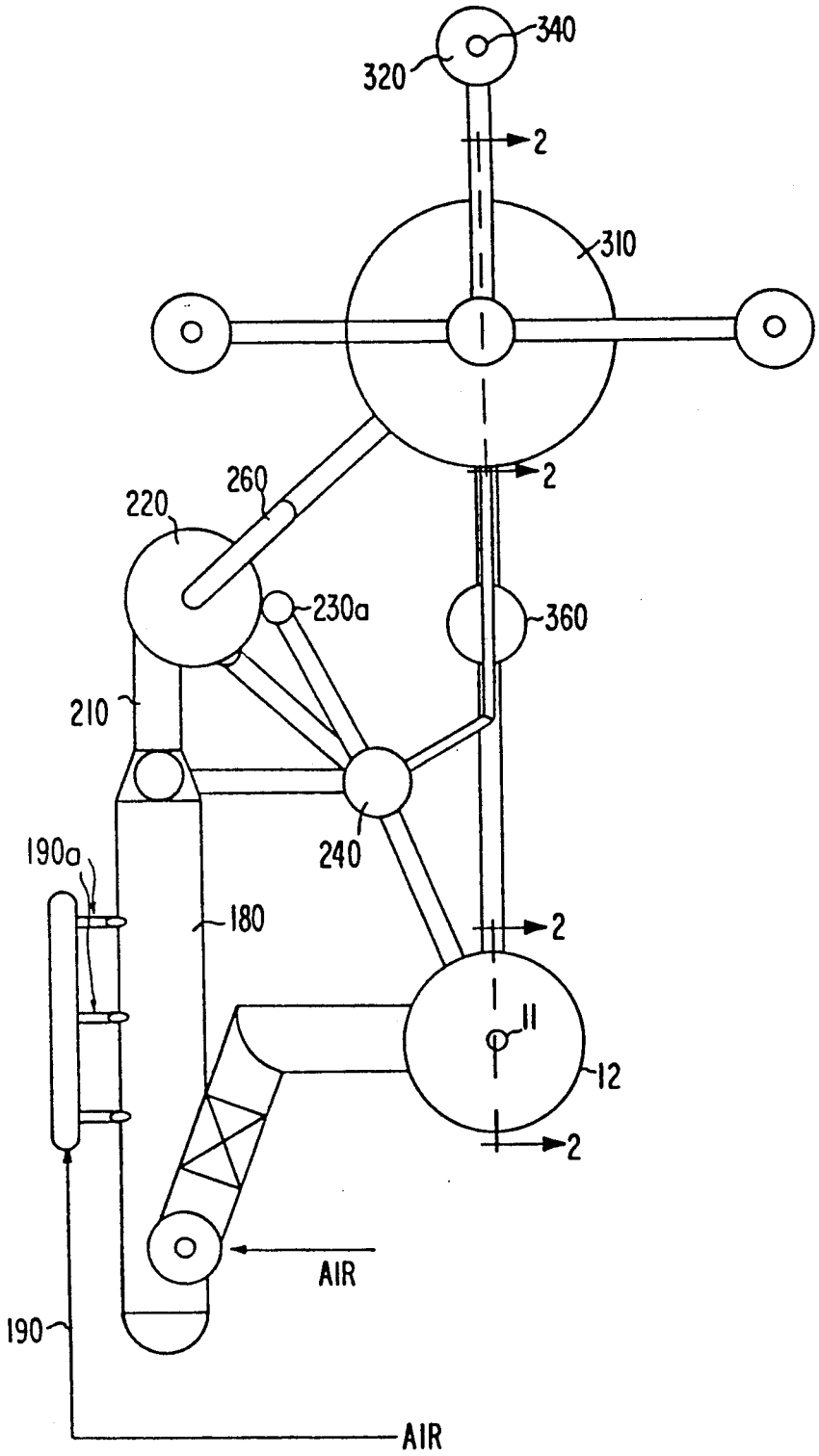
FIG. 3 is a diagrammatic illustration (plan view) of the embodiment of FIG. 2.

Referring to the embodiment of the invention presented in FIG. 2, items (1) through (13), respectively, are the same as items (1) through (13*a*), respectively of FIG. 1. Referring now to FIGS. 2 and 3, spent and stripped combined solids are withdrawn through standpipe (140). Aeration steam is added through (150). Air from (170) is added to transport the solids from (140) through tangential nozzle (160) and to provide part of the oxygen containing gaS for combustion in the primary cyclone regenerator. The flow through this nozzle initiates the centrifugal forces within the primary regenerator (180). More air is added through (190) to provide a high partial pressure of oxygen along the periphery of the cyclone regenerator through tangential ports (190*a*) along the length of the cyclone regenerator (180) and to maintain the centrifugal forces. Vortex collection pocket (200) removes a portion of the regenerated coarse catalyst particles.

The combustion gases from (180) and finer solids exit through tangential nozzle (210) to the cyclone classifier (220) where the solids are separated from the combustion gases and the remaining coarse catalyst is removed from the finer sorbent solids through additional vortex collection pockets (230) and (230*a*) (not shown on the elevation drawing but marked in the plan view).

The catalyst is transferred to stripper (240) and stripping steam is added at (240*a*).

Fine sorbent material is withdrawn from the classifier (220) through standpipe (250) to the base of riser transport line (280) and is picked up by an excess of air to burn off a substantial amount of carbon still on the fine solids at (270). A sufficient amount of air is added at this point to not only burn the carbon, but also to provide enough oxygen to combust most of the CO remaining in the flue gases from the primary regeneration. Solids and air are separated at (290) and further combustion takes place in the second stage regenerator (310) of the remaining carbon on the sorbent and the CO in the flue gas at (300). The flue gases from classifier (220) exit through line (260) to (300) within the second stage regenerator (310). The flue gases from (310) which are low in $NO_x$, but contain $SO_x$, exit to cyclone (320) where entrained fine solids are removed from the flue gas and return to the fluidized bed in regenerator (310).

The fine sorbent material which now contains only traces of carbon and which has been brought up to maximum regenerator temperature by combustion of residual organics and CO contained in the flue gas at (300) are withdrawn through standpipe (350) to stripper (360). Steam is added at (370) for stripping flue gas components from the solids.

Regenerated sorbent is withdrawn from the stripper (370) through standpipe (380) and proceeds to valve (1) at the base of the reactor riser (2). A predetermined quantity of regenerated sorbent is withdrawn for disposal through line (380*a*) which contains a small fraction of heavy metal components to be passivated or recovered while fresh sorbent is added at (380*b*). Vents (390) and (400) from strippers (240) and (360) enter regenerator (310) in the freeboard area.

EXAMPLE 1

Although the present invention contemplates staged solids contacting in one or more risers, scoping studies were conducted with a modified MAT procedure described in the '902 patent, supra. The catalyst bed was segregated into two equal portions (by weight). Steamed sorbent (U.S. Pat. No. 4,781,818), hereinafter "S", was used as the sorbent and high zeolite content octane catalyst (EPA 86301413.0), hereinafter "ZC", was used as the zeolitic catalyst. Two feeds, a standard AMOCC gas oil (low nitrogen) and Maya whole crude were used in these initial studies. For both feeds the configuration of S followed by ZC showed higher activity than the opposite (i.e., it was clearly preferable to place a sorbent in front of the zeolite). However, a comparison of this configuration with the situation in which ZC was mixed with S was less definitive. With the gas oil feed, the staged solids were marginally better than the mixed case in terms of gas production. Apparently the gas oil had so few contaminants that a small amount of sorbent was sufficient to protect the zeolite and a high-N gas oil containing basic nitrogen contaminants would be expected to demonstrate the benefit of using S in the lower portion of the bed. With the Maya whole crude, thermal cracking of the feed over the sorbent confounded the interpretation of results.

EXAMPLE 2

The effects of a nitrogenous poison on the staged catalyst system (S sorbent followed by ZC catalyst) was addressed in initial MAT cracking runs with MAT reactors totally filled with either the sorbent or the zeolite. The cracking of a gas oil (AMOCO) with and without a basic nitrogen compound (in this case, 2255 wt. ppm N as quinoline) was studied for both materials. The MAT numbers were calculated and the nitrogen contents were measured for all liquid products.

Data from these experiments are summarized below. Each experiment was run in duplicate as a measure of reproducibility.

| CATALYST | FEED | FEED N (WPPM) | PRODUCT N (WPPM) | NORMALIZED MAT |
|---|---|---|---|---|
| ZC | AMOCO | 784 | 61 | 78.4 |
| ZC | AMOCO | 784 | 313 | 78.2 |
| ZC | AMOCO + Q(?) | 2255(?) | 67 | 78.2 |
| ZC | AMOCO + Q | 2255 | 138 | 69.5 |
| S | AMOCO | 784 | 354 | 4.2 |
| S | AMOCO | 784 | 284 | 3.6 |
| S | AMOCO + Q | 2255 | — | 3.2 |

Considering first the effect of quinoline sorption on the cracking of gas oil by the zeolitic catalyst, note the first four tests. Both the MAT number and the product N-analysis make run identified as "AMOCO+Q" questionable. It appears that this was run on un-spiked gas oil and not on the spiked feed. Comparing the results on this basis, it appears that the zeolite is a very specific sorbent for the quinoline and that the catalyst was poisoned by the sorbed quinoline, losing 8.7 MAT actively units.

With regard to S catalytically inert sorbent, considered the last four entries in the table. S removed over 80% of the quinoline from the feed. The sorbed quinoline has very little effect on cracking with S since very little cracking occurs over S with or without added N-poisons.

From this data it was concluded that S will effectively act as a sorbent to "protect" zeolitic cracking catalysts such as ZC octane catalyst from the deterious effects of basic poisons such as quinoline.

We claim:

1. An apparatus for catalytically cracking hydrocarbon feedstock to form gaseous cracking products therefrom by contacting the feedstock with fluidizable solid sorbent particles and fluidizable solid catalyst particles, the sorbent particles being one or both of finer in size and less dense than the catalyst particles, such as to permit physical separation therebetween, the apparatus comprising:

a riser having a lower zone for vaporizing a hydrocarbon feedstock, an upper zone above the lower zone for cracking the feedstock, a feedstock inlet means below the lower zone for receiving the feedstock and an outlet means above the upper zone for discharging the feedstock from the riser;

a first inlet means in flow communication with the lower zone to charge the fluidizable solid sorbent particles into the lower zone;

a second inlet means in flow communication with the upper zone to charge the fluidizable solid catalyst particles into the upper zone whereby the fluidizable sorbent and catalyst solids are commingled in the riser;

gas/solid separation means in communication with the outlet means for separating the gaseous cracking products from the commingled fluidizable solids;

stripper means in flow communication with the riser outlet means for stripping carbonaceous deposits from the commingled fluidizable solids discharged from the riser outlet means;

a primary regenerator means;

first transfer means to transfer the stripped commingled fluidizable solids from the stripper means to the primary regenerator means;

sorbent/catalyst separation means in communication with the primary regenerator means and dimensioned and configured to effect physical separation of the sorbent and catalyst fluidizable solids discharged from the primary regenerator means by reason of the finer and/or less dense nature of the sorbent particles as compared to the catalyst particles to provide segregated sorbent and catalyst solids;

a secondary regenerator means;

means for conducting the segregated sorbent particles from the sorbent/catalyst separation means to the secondary regenerator means for regeneration of the sorbent therein;

means for conducting the sorbent particles from the secondary regenerator means to the first inlet means for discharge therefrom into the lower zone as defined above; and means for conducting the catalyst particles from the sorbent/catalyst separation means to the second inlet means for discharge therefrom into the upper zone as defined above.

2. The apparatus of claim 1 wherein the primary regenerator means comprises a transfer conduit and the secondary regenerator comprises a cyclonic separator.

3. The apparatus of claim 1 wherein the primary regenerator means comprises catalyst/sorbent separation means whereby the fluidizable sorbent and catalyst particles can be simultaneously at least partially regenerated and segregated.

4. The apparatus of claim 3 wherein the primary regenerator means comprises a cyclonic burner.

5. The apparatus of claim 4 wherein the cyclonic burner is a horizontally disposed cyclonic burner.

6. The apparatus of claim 4 or claim 5 further including air inlet means dimensioned and configured to introduce air tangentially into the cyclonic separator to maintain a relatively oxygen-rich environment at the periphery of the interior of the cyclonic separator as compared to the relatively oxygen-poor environment at the center of the interior of the cyclonic separator, whereby the coarser and/or denser catalyst particles are subjected to the oxygen-rich environment and the finer and/or less dense sorbent particles are subjected to the oxygen-poor environment.

* * * * *